United States Patent [19]

Golz

[11] Patent Number: 4,733,849

[45] Date of Patent: Mar. 29, 1988

[54] MOLD FOR PRODUCING GRID PLATES FOR LEAD BATTERIES

[75] Inventor: Hans-Joachim Golz, Hanover, Fed. Rep. of Germany

[73] Assignee: Varta Batterie Aktiengesellschaft, Hanover, Fed. Rep. of Germany

[21] Appl. No.: 772,320

[22] Filed: Sep. 4, 1985

[30] Foreign Application Priority Data

Sep. 13, 1984 [DE] Fed. Rep. of Germany ..... 3433583

[51] Int. Cl.[4] ..... B22D 25/04; B22D 27/04

[52] U.S. Cl. ..... 249/60; 164/127; 249/80; 249/111

[58] Field of Search ..... 164/271, DIG. 1, 122, 164/125, 138, 126, 127, 348; 249/111, 135, 60, 79, 80

[56] References Cited

U.S. PATENT DOCUMENTS

| | | | |
|---|---|---|---|
| 1,652,445 | 12/1927 | Lee | 164/127 |
| 1,994,634 | 3/1935 | Broughton | 164/125 X |
| 2,194,092 | 3/1940 | Lund | 249/60 |
| 2,807,065 | 9/1957 | DenDooven, Jr. | 164/125 X |

FOREIGN PATENT DOCUMENTS

| | | | |
|---|---|---|---|
| 1155833 | 10/1963 | Fed. Rep. of Germany . | |
| 56-114552 | 9/1981 | Japan | 164/127 |

*Primary Examiner*—Nicholas P. Godici
*Assistant Examiner*—J. Reed Batten, Jr.
*Attorney, Agent, or Firm*—Weiser & Stapler

[57] ABSTRACT

The accumulations of molten lead which correspond to the lugs and frames of molded starter battery plates can be caused to solidify at the same rate as the much thinner grids of the plates by providing a mold having inserts made from a material whose thermal conductivity is higher than that of the base material of the mold in the regions of the mold which are used to form the lugs and frames, provided these inserts are disposed as close as possible to a system of cooling channels. The ratio of the thermal conductivity of the material from which the inserts are made to the thermal conductivity of the base material of the mold should approximate the ratio of the material accumulations on the lugs and frames to that on the rest of the grid.

8 Claims, 1 Drawing Figure

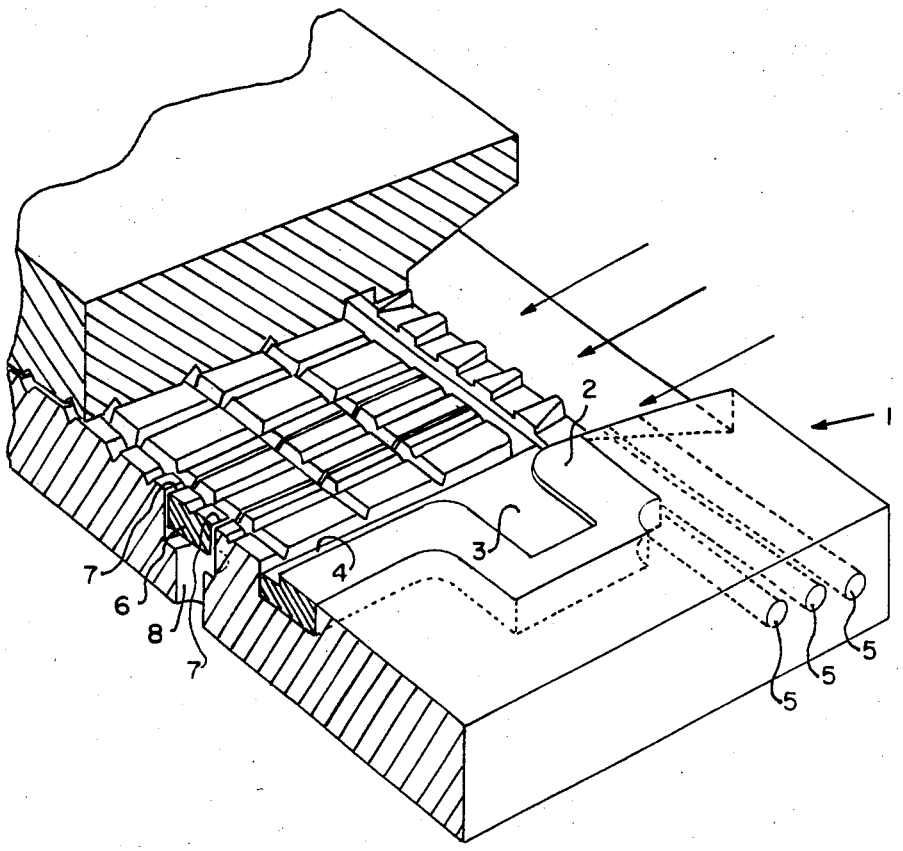
1
2
3
4
5
5
5
6
7
7
8

MOLD FOR PRODUCING GRID PLATES FOR LEAD BATTERIES

BACKGROUND OF THE INVENTION

The present invention relates generally to a mold for producing grid plates for lead batteries, especially grid plates for starter batteries, which tend to combine thickened frames and plate lugs with relatively thin grid ribs and webs.

Grid molds for starter battery grids are generally made from cast iron. Generally, two separate mold halves are held in a hinged mold holder or tensioning block such that each mold half is separately replaceable. To promote rapid cooling of the lead melt which is ultimately poured into the mold, the mold holder is provided with a series of cooling channels, which are preferably distributed in such a way that those surfaces which are most heated are exposed to the most effective cooling.

To obtain a good casting, pretreatment of the mold by coating it with talc, graphite or ground cork is absolutely necessary. Such mold-coating compounds, as a general rule, serve three purposes. A primary purpose of the coating is to provide insulation. However, because such compounds prevent the lead from adhering to the mold, such coatings also serve as a highly effective mold release or parting agent. Such coatings also permit air which is present in the mold cavity to escape to the nearest vent hole, at least over short distances and through pore spaces which are not filled by the lead.

However, it is just as important that the coating form a barrier to the transfer of heat from the lead melt to the mold material, which has relatively good thermal conductivity, to ensure that the molten lead does not prematurely solidify when it is poured into the mold, but rather is able to completely fill the mold cavity.

Consequently, renewal of the powder layer is required after each casting sequence. This operation may, for example, be advantageously carried out by means of a compressed air atomizer or the like. However, after a series of such applications, the dissipation of heat from the molten lead melt tends to take place much more slowly from those areas of the mold which form the lugs and frames than from those areas of the mold which form the latticework of the grid webs, where less material tends to accumulate. As a result, it has become common practice to scrape the coating layer which is present in the regions which form the lugs and frames of the grid plates, before the mold is again powdered, in order to equalize contact with the thermally conductive mold material. However, there are shortcomings in connection with such scraping procedures, primarily because the coating at the edges of the area being scraped inevitably becomes frayed, which subsequently causes relatively large pieces of the coating to chip off during use of the treated mold.

Equalization of the rate of cooling of the thick and thin parts of the plate grid can be achieved in a mold such as is known from DE-PS No. 1 155 833. Described in this patent is a mold having two one-piece mold halves, each of which has portions in the middle which contain recesses corresponding to the grid ribs and webs, as well as portions at the edges with a larger recess corresponding to the frame of the plate. The mid-portions of each of the mold halves are separated from the mold holders by an air gap. A direct heat-conducting connection is developed between the edge portions of the mold halves and the corresponding mold holders. As a result, the dissipation of heat from the thin latticework is delayed by the insulating air pockets which are formed.

SUMMARY OF THE INVENTION

It is the principal object of the present invention to provide a mold for casting battery grid plates which makes it possible to equalize the different rates of cooling of the frame and of the latticework, while avoiding cumbersome treatments after each casting operation, or other such time consuming measures, so as to achieve a more rapid production process.

This and other objects are achieved according to the present invention by providing a grid mold which is generally comprised of two mold halves formed of a base material, each of which includes portions which are made from a material having a higher thermal conductivity than the base material of the mold in selected regions which tend to accumulate material, such as the regions which are used to form the frames and lugs of the grid plate. Those portions of the mold which exhibit this higher thermal conductivity are placed either in direct contact, or indirect contact at a greater depth, with channels for receiving a cooling medium.

Consequently, there is an accelerated dissipation of a disproportionately larger amount of heat from the lead melt in those portions of the mold cavities which correspond to the lugs and plate frames, a result which cannot be achieved by simply enlarging the surface of the hollow mold cavity, due to the higher thermal conductivity of the mold material in these regions, and due to active support by a cooling agent.

Further detail regarding a preferred embodiment grid mold in accordance with the present invention may be had with reference to the detailed description which is provided below, taken in conjunction with a single illustration which shows a partial isometric view of the grid mold of the present invention.

DETAILED DESCRIPTION OF A PREFERRED EMBODIMENT

Shown in the drawing is a grid mold 1 formed of a base material and including an insert 2 having recesses 3, 4 shaped to the contours of the lug (recess 3) and frame (recess 4) of a grid casting. In conventional fashion, the lead melt enters the mold 1 from the upper right of the mold 1, in the direction of the arrows shown in the drawing.

Gray cast iron or certain steel alloys may be used as the base material of the grid mold 1. In accordance with the present invention, the insert 2 is provided to, in essence, replace selected portions of the grid mold 1 with a material of higher thermal conductivity in those regions of the mold 1 in which material tends to accumulate. In forming the insert 2, copper is a suitable material for the purposes of the present invention, having a thermal conductivity of 384 W/m.K as compared with 58 W/m.K for gray cast iron. Thus, the dissipation of heat is improved by a factor of 6.6. Aluminum, having a thermal conductivity of 204 W/m.K, may also be used in some cases, although this thermal conductivity decreases to about 172 W/m.K in the case of aluminum alloys, and to only 33 W/m.K in the case of aluminum bronze (with an aluminum content of 10%).

In combination with proper design of the "heat-conducting bridges" which are developed by means of the inserts 2, the thermal conductivities exhibited by the above-described materials serve to exactly achieve the heat dissipation which is required to optimize the casting process. This is because what is of primary importance in such a casting process in order to achieve the shortest possible cycle times, is that the temperatures of all portions of the molded grid drop as uniformly as possible below the temperature which must be maintained before the grid can be removed from the mold, especially in order to prevent thermal cracks and similar defects.

A particularly desirable grid mold according to the present invention is obtained when the ratio of the thermal conductivity of the insert (the material with the higher thermal conductivity) to the thermal conductivity of the base material of the mold is approximately the same as the ratio of the specific material accumulation on the thicker portions of the battery plate to the material distribution over the grid surface.

As an alternative, the improvements of the present invention can also be achieved by varying the cross-section of those portions of the mold which are formed from the material of high thermal conductivity in such a way that the thermal conductivity of the mold material is adjusted by varying the cross-section of the mold. Preferably, this adjustment is performed such that, in the desired areas of the mold, heat dissipation is increased by the ratio of the material accumulation on the thicker portions of the battery plate to the material distribution over the grid surface.

In either case, the resulting heat-conducting bridges are fully effective only when their rear side is operatively associated with one or more channels capable of receiving an appropriate cooling agent. This is because of the effect of temperature on thermal conductivity, which inherently increases with increasing temperature difference. In general, water or oil are useful as the cooling agent, which flows within a series of channels 5 disposed within the mold 1, preferably close to the insert 2.

In practice, the inserts 2 are inserted in the necessary locations before the mold 1 is engraved. Preferably the parts are symmetrical in the vicinity of the lugs, because inserts of this type are most easily prepared and fitted. In the vicinity of the frame, the inserts preferably take the form of bars which have stalks spaced relatively close to one another, and which lead to the cooling channels. The resulting heat-conducting bridges are individually dimensioned for each grid configuration to be cast in order to achieve the goal of simultaneous cooling for each of the different grid constructions.

As a means of ventillation, so-called air cells or vent bars 6 are recessed in the mold surface during engraving of the mold 1. These vent bars 6 are inserts similar to the heat-conducting bridges according to the present invention, but are formed of the same base material as the mold 1. The vent bars 6 permit air which is trapped in the grooves of the web by the inflow of lead to escape via capillary gaps 7 which are developed between the mold 1 and the vent bars 6, and through the vent 8.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. A mold for producing grid plates for lead batteries, wherein said grid plates have grids, and frames and plate lugs which are thicker than the grids of said plates, and wherein said mold is comprised of two mold halves made of a base material and including mold portions which are made from a material having a higher thermal conductivity than the base material of the mold wherein the regions of the mold halves which are used to cast the grids are formed of the base material, and the regions of the mold halves which are used to cast the frames and plate lugs are made from the material of higher thermal conductivity.

2. The mold of claim 1 wherein the base material is gray cast iron or a steel alloy and the material of higher thermal conductivity is copper.

3. The mold of claim 1 wherein those portions of the mold halves which are formed of the material of higher therma1 conductivity are operatively associated with channels for receiving a cooling medium.

4. The mold of claim 1 wherein the portions of the mold halves which are formed of the material of higher thermal conductivity are inserts provided in the surfaces of the mold halves.

5. The mold of claim 1 wherein the ratio of the thermal conductivity of the material of higher thermal conductivity to the thermal conductivity of the base material approximates the ratio of specific material accumulation on the thicker portions of the grid plates to the material distribution over the grids.

6. The mold of claim 1 wherein the cross-section of the portions of the mold halves which are made from the material of higher thermal conductivity are dimensioned so that heat dissipation in said portions is increased in proportion to the ratio of material accumulation on the thicker portions of the grid plates to the material distribution over the grids.

7. The mold of claim 1 wherein the mold portions which are made from the material having the higher thermal conductivity are placed within the mold so that the rate of cooling of the thicker frames and plate lugs is equalized with the rate of cooling of the grids of said plates.

8. A mold for producing grid plates for lead batteries, wherein said grid plates have grids, and frames and plate lugs which are thicker portions than the grids of said plates, and wherein said mold is comprised of two mold halves made of a base material and having regions which are used to cast the grids of said plates, and including mold portions which are made from a material having a higher thermal conductivity than the base material of the mold in selected regions which are used to cast the frames and plate lugs, wherein the ratio of the thermal conductivity of the material of higher thermal conductivity to the thermal conductivity of the base material approximates the ratio of specific material accumulation on the thicker portions of the grid plate to the material distribution over the grid.

* * * * *